US011730655B2

(12) United States Patent
Ahearn

(10) Patent No.: US 11,730,655 B2
(45) Date of Patent: Aug. 22, 2023

(54) DENTAL CHAIR

(71) Applicant: David J. Ahearn, Little Compton, RI (US)

(72) Inventor: David J. Ahearn, Little Compton, RI (US)

( * ) Notice: Subject to any disclaimer, the term of this patent is extended or adjusted under 35 U.S.C. 154(b) by 0 days.

(21) Appl. No.: 17/843,876

(22) Filed: Jun. 17, 2022

(65) Prior Publication Data

US 2023/0030097 A1 Feb. 2, 2023

Related U.S. Application Data

(63) Continuation-in-part of application No. 16/863,637, filed on Apr. 30, 2020, now Pat. No. 11,369,539.

(60) Provisional application No. 62/847,119, filed on May 13, 2019.

(51) Int. Cl.

| | |
|---|---|
| ***A47C 1/024*** | (2006.01) |
| ***A47C 1/032*** | (2006.01) |
| ***A61G 15/08*** | (2006.01) |

(52) U.S. Cl.

CPC ..... *A61G 15/08* (2013.01)

(58) Field of Classification Search

CPC ..... A61G 15/02; A61G 15/10
USPC ..... 297/330
See application file for complete search history.

(56) References Cited

U.S. PATENT DOCUMENTS

| | | | |
|---|---|---|---|
| 271,596 | A | 2/1883 | Browne |
| 1,373,079 | A | 3/1921 | King |
| 3,554,598 | A | 1/1971 | Dunkin |
| 3,866,973 | A | 2/1975 | Heubeck |
| 3,874,728 | A | 4/1975 | Weiland |
| 3,889,998 | A | 6/1975 | Weiland |
| 3,968,990 | A | 7/1976 | Heubeck |
| 3,984,146 | A | 10/1976 | Krestel et al. |
| 4,017,118 | A | 4/1977 | Cawley |
| 4,334,710 | A | 6/1982 | Milner, Jr. |
| 4,367,894 | A | 1/1983 | Manuel |
| 4,572,573 | A | 2/1986 | Yoshikawa et al. |
| D294,891 | S | 3/1988 | Gyaami |
| 4,778,216 | A | 10/1988 | Stupakis |
| 5,190,349 | A | 3/1993 | Austin, Jr. et al. |
| 5,214,360 | A | 5/1993 | Gonser et al. |
| 5,340,953 | A | 8/1994 | Krebs et al. |
| 5,547,245 | A | 8/1996 | Knouse |
| 5,628,546 | A | 5/1997 | Boetzkes |

(Continued)

FOREIGN PATENT DOCUMENTS

| | | |
|---|---|---|
| EP | 1 652 505 A2 | 5/2006 |

OTHER PUBLICATIONS

International Search Report and Written Opinion received for PCT Patent Application No. PCT/US2022/034105, dated Sep. 12, 2022, 9 pages.

(Continued)

*Primary Examiner* — Rodney B White
(74) *Attorney, Agent, or Firm* — Adler Pollock & Sheehan P.C.

(57) ABSTRACT

A dental chair having a plurality of modules that can be easily transported and assembled. The dental chair includes a chair module, a lift module, and a base module. The base module can be configured to releasably attach to and integrate with the lift module, and the lift module can be configured to releasably attach to and integrate with the chair module.

15 Claims, 19 Drawing Sheets

(56) References Cited

U.S. PATENT DOCUMENTS

| | | | | |
|---|---|---|---|---|
| 6,345,856 | B1 | 2/2002 | Minai | |
| 6,679,905 | B2 | 1/2004 | Peetros et al. | |
| 6,814,409 | B2 | 11/2004 | Jackson | |
| 7,290,836 | B2 | 11/2007 | Nordstrom et al. | |
| 7,862,123 | B2 | 1/2011 | Baker et al. | |
| 8,408,899 | B1 | 4/2013 | Smith et al. | |
| 8,991,925 | B2 | 3/2015 | Lapointe | |
| 11,369,539 | B2 * | 6/2022 | Ahearn | A61G 15/125 |
| 2010/0109407 | A1 | 5/2010 | Broering et al. | |
| 2010/0205742 | A1 | 8/2010 | Stone et al. | |
| 2010/0207432 | A1 | 8/2010 | Ochsner et al. | |
| 2011/0195374 | A1 | 8/2011 | Boren | |
| 2015/0320625 | A1 | 11/2015 | White | |
| 2020/0360218 | A1 | 11/2020 | Ahearn | |
| 2021/0077332 | A1 | 3/2021 | Maynard | |

OTHER PUBLICATIONS

European Search Report received for EP Patent Application No. 22802488.1, dated May 24, 2023, 4 pages.

* cited by examiner

DENTAL CHAIR

CROSS REFERENCE TO RELATED APPLICATIONS

This application is a continuation-in-part (CIP) of U.S. patent application Ser. No. 16/863,637 filed Apr. 30, 2020, now U.S. Pat. No. 11,369,539, which claims the benefit of U.S. Provisional Patent Application No. 62/847,119 filed May 13, 2019, the disclosures of each of which are incorporated, in their entirety, by this reference.

BACKGROUND OF THE INVENTION

The present invention relates generally to chairs and, in particular to a dental chair. In general, existing dental patient chairs are large and typically weigh four hundred or more pounds and are manufactured and shipped as a single unit. Such single unit dental chairs are not designed for disassembly. Thus, the heavy weight of dental chairs coupled with the fixed configuration make them cumbersome and challenging to move and position. In addition, the large size and heavy weight of such dental chairs increases shipping costs associated with transport of the dental chairs.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In one embodiment, a method of assembling a dental chair of an embodiment of the present disclosure includes providing a base module having a plurality of base fasteners. Next, coupling a lift module to the base module, where the lift module includes a plurality of keyed apertures configured to receive the plurality of base fasteners such that when the lift module is coupled to the base module, the plurality of keyed apertures are aligned and secured with the plurality of base fasteners to prevent a vertical axial movement of the lift module. The method is followed by coupling a chair module to the lift module, the chair module having a fastening mechanism configured to releasably attach to the lift module.

In one embodiment, the base module further includes a base plate, where electronic components and the plurality of base fasteners are disposed on the base plate. In this embodiment, the method further includes powering at least one of the lift module and the chair module with the electronic components.

In an embodiment, the powering step further includes powering additional features of at least one of the lift module and the chair module with the electronic components, where wirings for the electronic components are electrically coupled to portions of at least one of the lift module and the chair module.

In one embodiment, the lift module includes a lift, a post positioned on a distal end of the lift, and a plate having towers configured to rotatably secure a proximal end of the lift to the plate. In this embodiment, the method further includes actuating the lift such that the lift module can be raised or lowered so as to facilitate comfort and ease of coupling the chair module to the lift module.

In an embodiment, coupling the chair module to the lift module further includes removably coupling the fastening mechanism of the chair module to the post of lift module, where the post is substantially cylindrical in shape. In one embodiment, the post of the lift module may have threads for mating with a corresponding cavity of the chair module.

In some embodiments, the chair module may have traverse rollers and the lift module may have traverse rails configured to receive the traverse rollers such that the chair module can be slidably received by the lift module. In other embodiments, the chair module may have an engagement aperture and the lift module may have an engagement bar configured to be aligned with the engagement aperture such that the chair module is securely attached to the lift module via a locking pin through the engagement aperture and the engagement bar.

In one embodiment, the chair module includes a back rest assembly, a head rest assembly slidably attachable to an upper end of the back rest assembly, an arm rest assembly, a seat assembly slidably attachable to a lower end of the back rest assembly, and a leg rest assembly slidably attachable to the seat assembly. In this embodiment, the method further includes attaching upholstery to at least one of the back rest assembly, the head rest assembly, the arm rest assembly, the seat assembly and the leg rest assembly.

In some embodiments, each of the base module, the lift module and the chair module is made of metal and does not exceed a specified weight of about 150 pounds, or about 100 pounds.

In one embodiment, a method of assembling a dental chair using modules according to an embodiment of the present disclosure includes providing a lift module joined with a base module. The base module includes a base plate and a plurality of base fasteners disposed on the base plate. The lift module includes a plurality of keyed apertures configured to receive the plurality of base fasteners.

In operation, the lift module can be joined with or mounted over the base module such that the plurality of keyed apertures are aligned and secured with the plurality of base fasteners to prevent a vertical axial movement of the lift module with respect to the base module.

Next, the method includes attaching a chair module to the lift module via a fastening assembly, where the fastening assembly includes the chair module having traverse rollers and the lift module having traverse rails configured to receive the traverse rollers.

In one embodiment, the method further includes powering at least one of the lift module and the chair module with electronic components mounted on the base plate. In some embodiments, the powering step further includes powering additional features of at least one of the lift module and the chair module with the electronic components, where wirings for the electronic components are electrically coupled to portions of at least one of the lift module and the chair module.

In an embodiment, the lift module further includes a lift, and a plate having towers configured to rotatably secure a proximal end of the lift to the plate. In this embodiment, the method further includes actuating the lift such that the lift module can be raised or lowered so as to facilitate comfort and ease of releasably attaching the chair module to the lift module.

In one embodiment, releasably attaching the chair module to the lift module further includes mating a cavity of the chair module to the post of the lift module, the post being substantially cylindrical in shape and having corresponding threads for mating with the cavity.

In one embodiment, releasably attaching the chair module to the lift module via the fastening assembly further includes the chair module having an engagement aperture and the lift module having an engagement bar configured to be aligned with the engagement aperture such that the chair module is securely attached to the lift module via a locking pin through the engagement aperture and the engagement bar.

In one embodiment, the chair module includes a back rest assembly, a head rest assembly slidably attachable to an upper end of the back rest assembly, an arm rest assembly, a seat assembly slidably attachable to a lower end of the back rest assembly, and a leg rest assembly slidably attachable to the seat assembly. In this embodiment, the method further includes attaching upholstery to at least one of the back rest assembly, the head rest assembly, the arm rest assembly, the seat assembly and the leg rest assembly.

In one embodiment, a method of assembling a dental chair using modules according to an embodiment of the present disclosure includes providing a base module having a plurality of base fasteners.

Next step includes coupling a lift module to the base module, the lift module having a plurality of keyed apertures configured to receive the plurality of base fasteners such that when the lift module is coupled to the base module, the plurality of keyed apertures are aligned and secured with the plurality of base fasteners to prevent a vertical axial movement of the lift module.

The method is then followed by providing a chair module having a back rest assembly, a head rest assembly slidably attachable to an upper end of the back rest assembly, an arm rest assembly, a seat assembly slidably attachable to a lower end of the back rest assembly, and a leg rest assembly slidably attachable to the seat assembly.

Subsequently, the method includes attaching the chair module to the lift module via a fastening assembly, where the fastening assembly includes the chair module having traverse rollers and the lift module having traverse rails configured to receive the traverse rollers.

The last step of this method includes attaching upholstery to at least one of the back rest assembly, the head rest assembly, the arm rest assembly, the seat assembly and the leg rest assembly.

In one embodiment, the method further includes powering at least one of the lift module and the chair module with electronic components mounted on the base module, and powering additional features of at least one of the lift module and the chair module with the electronic components, where wirings for the electronic components are electrically coupled to portions of at least one of the lift module and the chair module.

In another embodiment, the lift module further includes a lift, and a plate having towers configured to rotatably secure a proximal end of the lift to the plate. In this embodiment, the method further includes actuating the lift such that the lift module can be raised or lowered so as to facilitate comfort and ease of releasably attaching the chair module to the lift module.

In an aspect, the invention features a dental including a chair module, a lift module, and a base module, the base module configured to releasably attach to and integrate with the lift module, the lift module configured to releasably attach to and integrate with the chair module.

In another aspect, the invention features a method including providing a chair module with a fastening mechanism, the chair module not exceeding a specified weight, providing a lift module configured to attach to the fastening mechanism of the chair module, the lift module not exceeding the specified weight, and providing a base module configured to attach to the lift module, the base module not exceeding the specified weight.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
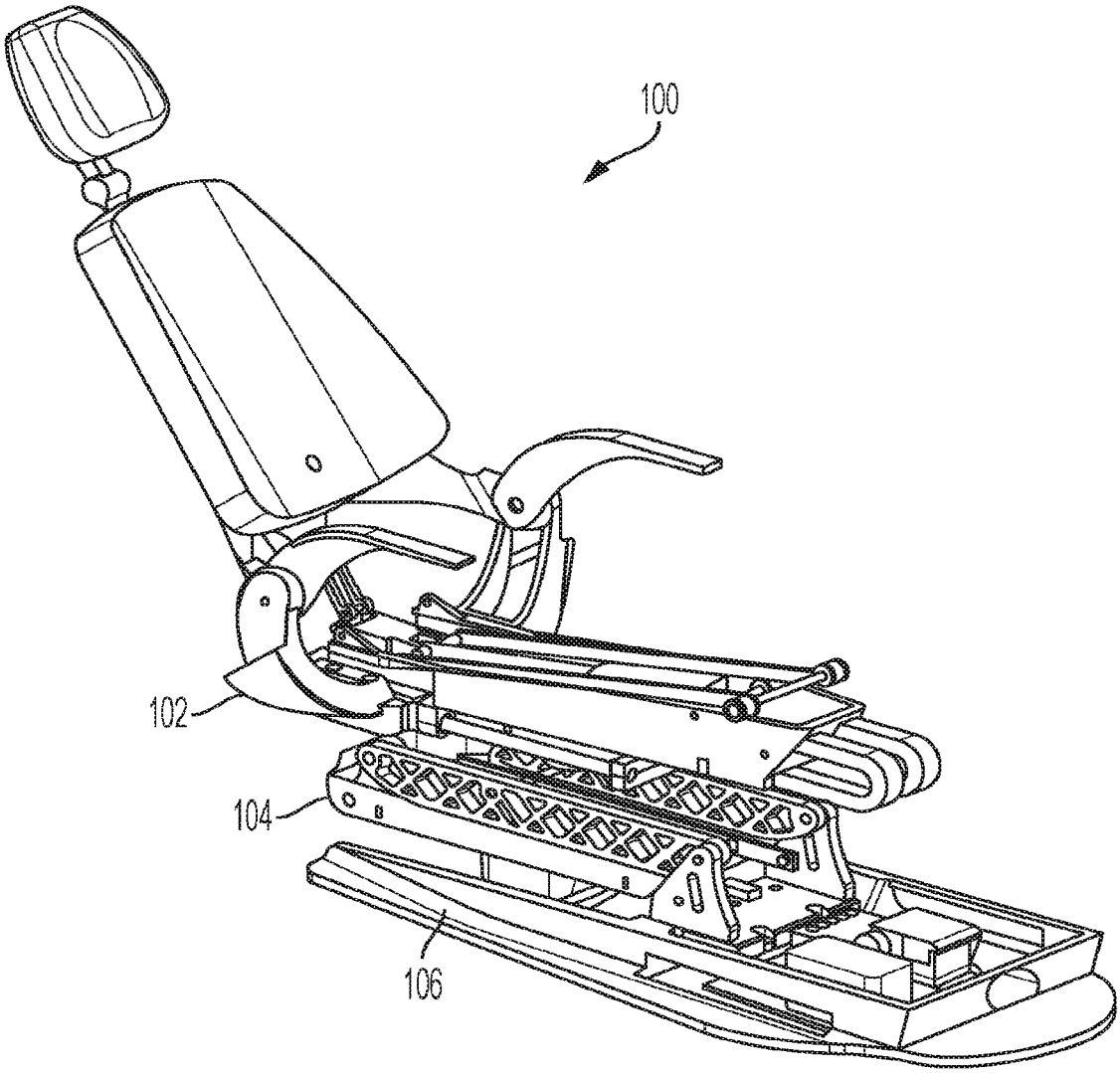
FIG. 1 illustrates an exemplary modular dental chair.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

The present invention provides a dental patient chair that includes separate modules which can be easily assembled and disassembled. In contrast to a single-unit dental chair, a reduced weight and footprint of each of the modules makes them less cumbersome and easier to maneuver into place. The dental chair of the present invention substantially reduces shipping costs by enabling a shipping of each module in a separate container using common carriers such as, for example, United Parcel Service ("UPS") and FedEx.

This avoids the expense of shipping an entire single-unit dental chair that often must use specialized carriers that ship heavy items and charge hefty premiums.

As shown in FIG. 1, an exemplary modular dental chair 100 includes modules that, when linked together as illustrated, form a single integrated unit. More specifically, the modular dental chair 100 includes a chair module 102, a lift module 104, and base module 106. In one embodiment, the modular dental chair 100 includes upholstery (not shown) that is associated with and affixed to the chair module 102. This upholstery provides a user, e.g., dental patient, with back, arm and posterior comfort, for example. Each of the modules 102, 104 and 106, along with appropriate upholstery, if needed, can be shipped separately and assembled on site. Moreover, each of the modules 102, 104 and 106 of the modular dental chair 100 may easily be disassembled for easy transport and shipping purposes. In a preferred embodiment, each individual module 102, 104, 106 is designed to weigh less than one hundred fifty pounds. This weight limit enables each module 102, 104, 106 to be shipped by a standard commercial carrier such as, for example, United Parcel Service ("UPS"). In a specific embodiment, each module 102, 104, 106 is constructed primarily in aluminum or other lightweight metal or composite material.

Figure 2:
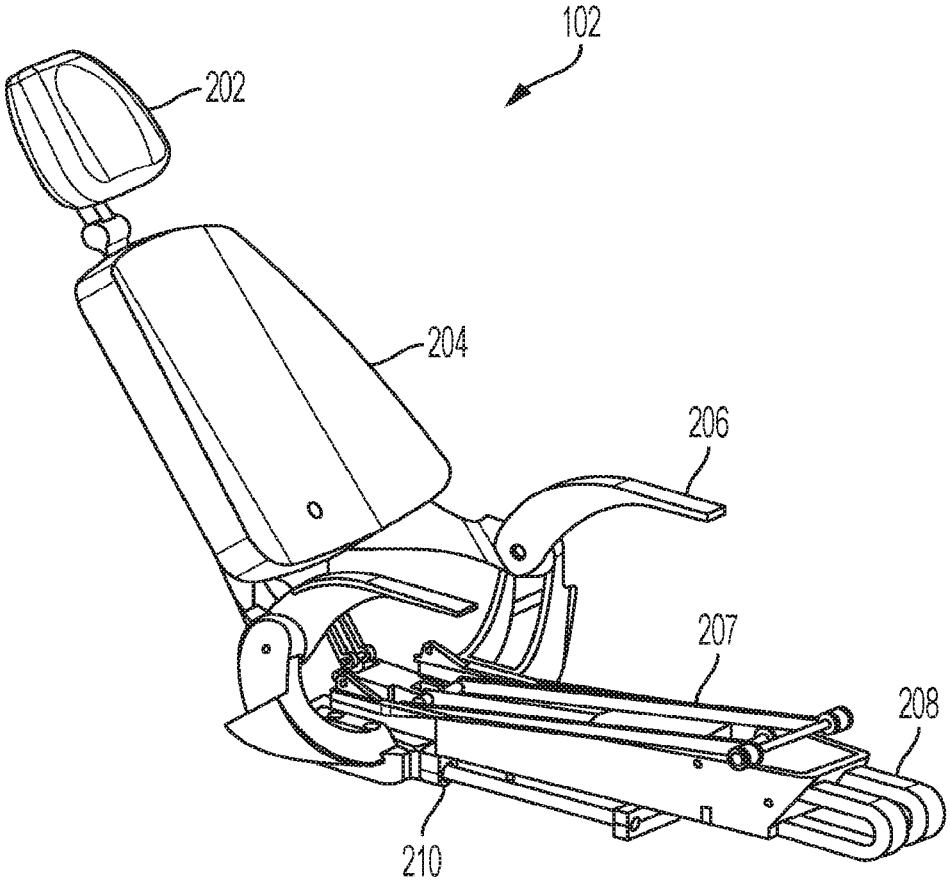
FIG. 2 illustrates an exemplary chair module.

As shown in FIG. 2, the chair module 102 includes at least a head rest assembly 202, a back rest assembly 204, an arm rest assembly 206, a seat assembly 207 and a leg rest assembly 208. The chair module 102 also includes a fastening mechanism 210, such as a threaded cavity or aperture, for releasably attaching the chair module 102 to the lift module 104.

In embodiments, the back rest assembly 204 is linked to the seat assembly 207 to enable movement of the back rest assembly 204 relative to the seat assembly 207.

In embodiments, the head rest assembly 202 and the back rest assembly 204 are slidably linked to each other to enable the head rest assembly 202 to move relative to the back rest assembly 204.

In embodiments, the leg rest assembly 208 is linked to the seat assembly 207 to enable movement of the leg rest assembly 208 relative to the seat assembly 207.

Figure 3:
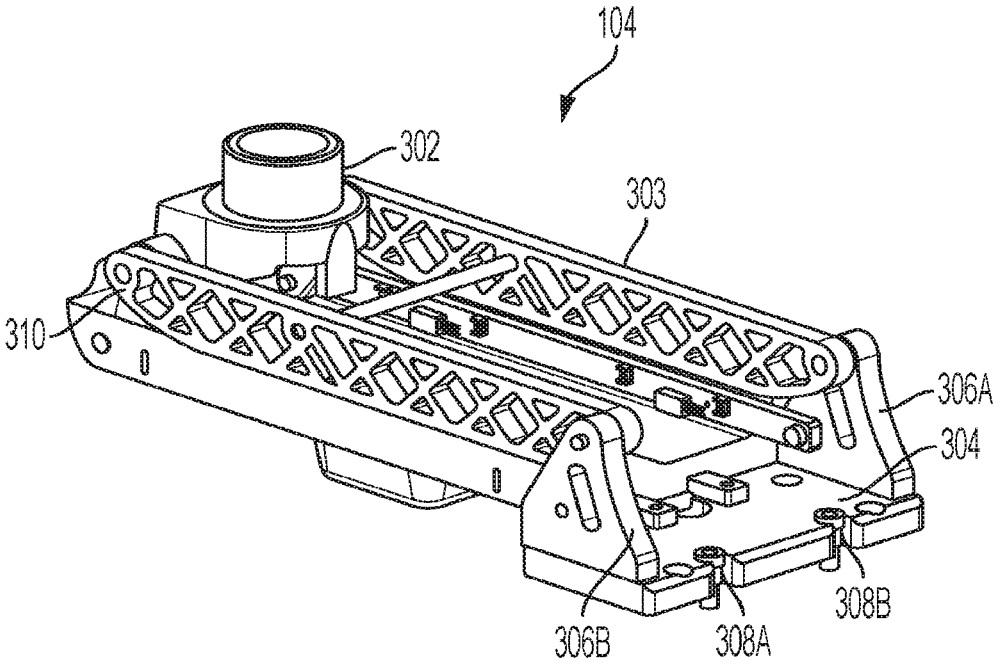
FIG. 3 illustrates an exemplary lift module.

As shown in FIG. 3, the lift module 104 includes a post 302, a lift 303 and a plate 304. The lift 303 is attached to plate towers 306A, 306B on its proximal end which enable to lift 303 to be raised and lower as it rotates on the plate towers 306A, 306B. The post 302 is attached to a distal end of the lift 303 and is configured to removably attach to the fastening mechanism 210 of the chair module 102. Once attached, the lift module 104 can raise, lower or otherwise maneuver the chair module 102.

The post 302, in an embodiment, is cylindrical in shape and made of metal or other material. The post 302 is utilized to securely attach the chair module 102 onto the lift module 104. In one embodiment, for further convenience, the post 302 can be threaded to mate with a corresponding threaded version of fastening mechanism 210 on chair module 102.

The plate 304 is utilized to attach the lift module 104 to the base module 106. The plate 304 is configured to align with the base plate 402 (as discussed below). The plate 304 can include multiple keyed apertures 308A, 308B that align with the fasteners (shown below) on the base plate module 106. In addition, the distal end of the lift 303 can include posts 310 designed to mate with the seat module 102 and aid in its attachment to the seat module 102.

Figure 4:
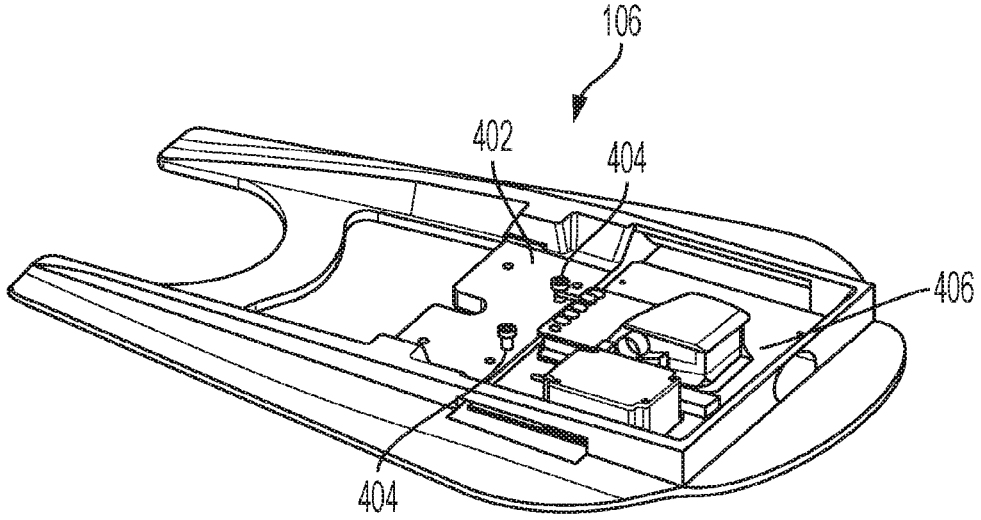
FIG. 4 illustrates an exemplary base module.

As shown in FIG. 4, the base module 106 includes at least a base plate 402 and fasteners (such as bolts) 404. The base plate 402 can receive and be secured to the lift module 104 using the fasteners 404 which are engaged in the apertures 308A, 308B. The base plate 402 also includes an electronic components section 406 housing electronic components that power the movements of the lift module 104 and additional features.

Figure 5:
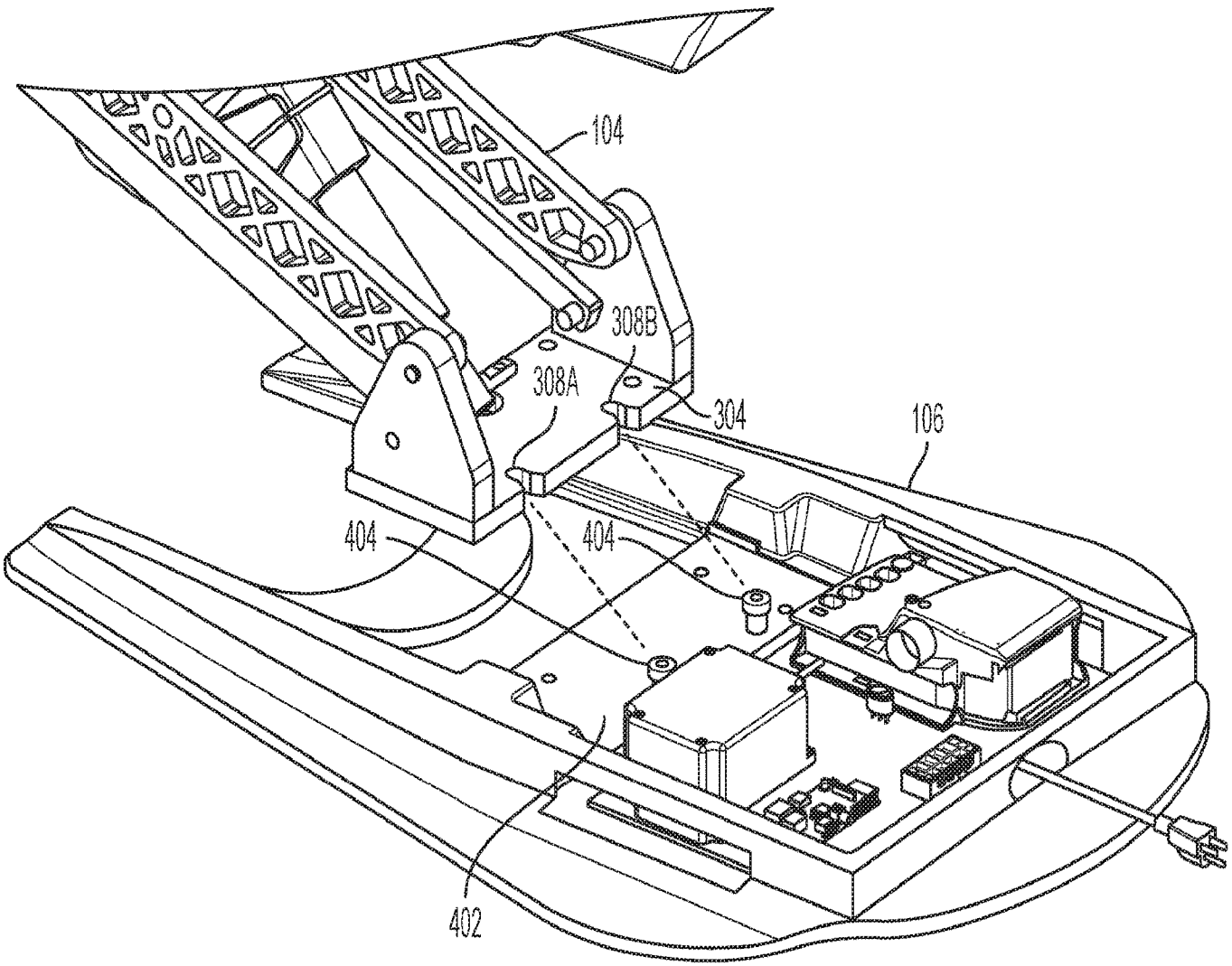
FIG. 5 illustrate lift and base modules.

In FIG. 5, the lift module 104 is shown being lowered onto the base module 106 such that the plate 304, when joined together, results in having the plate 304 flush against the plate 402 with the fasteners 404 on plate 402 aligned and secured in the keyed apertures 308A, 308B on the plate 304.

Figure 6:
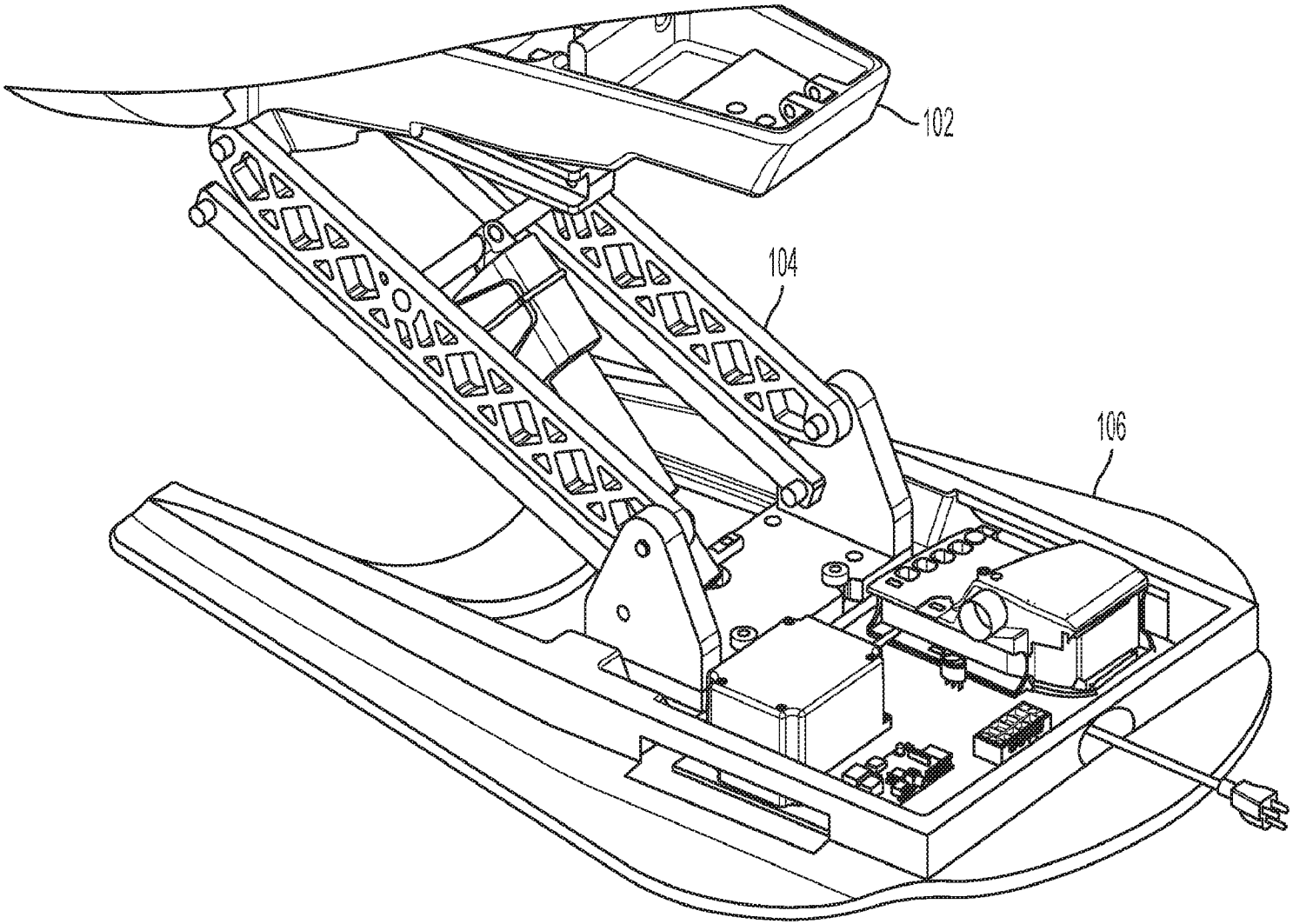
FIG. 6 illustrates chair, lift and base modules.

FIG. 6 illustrates the joining of the lift module 104 with the base module 106.

Figure 7:
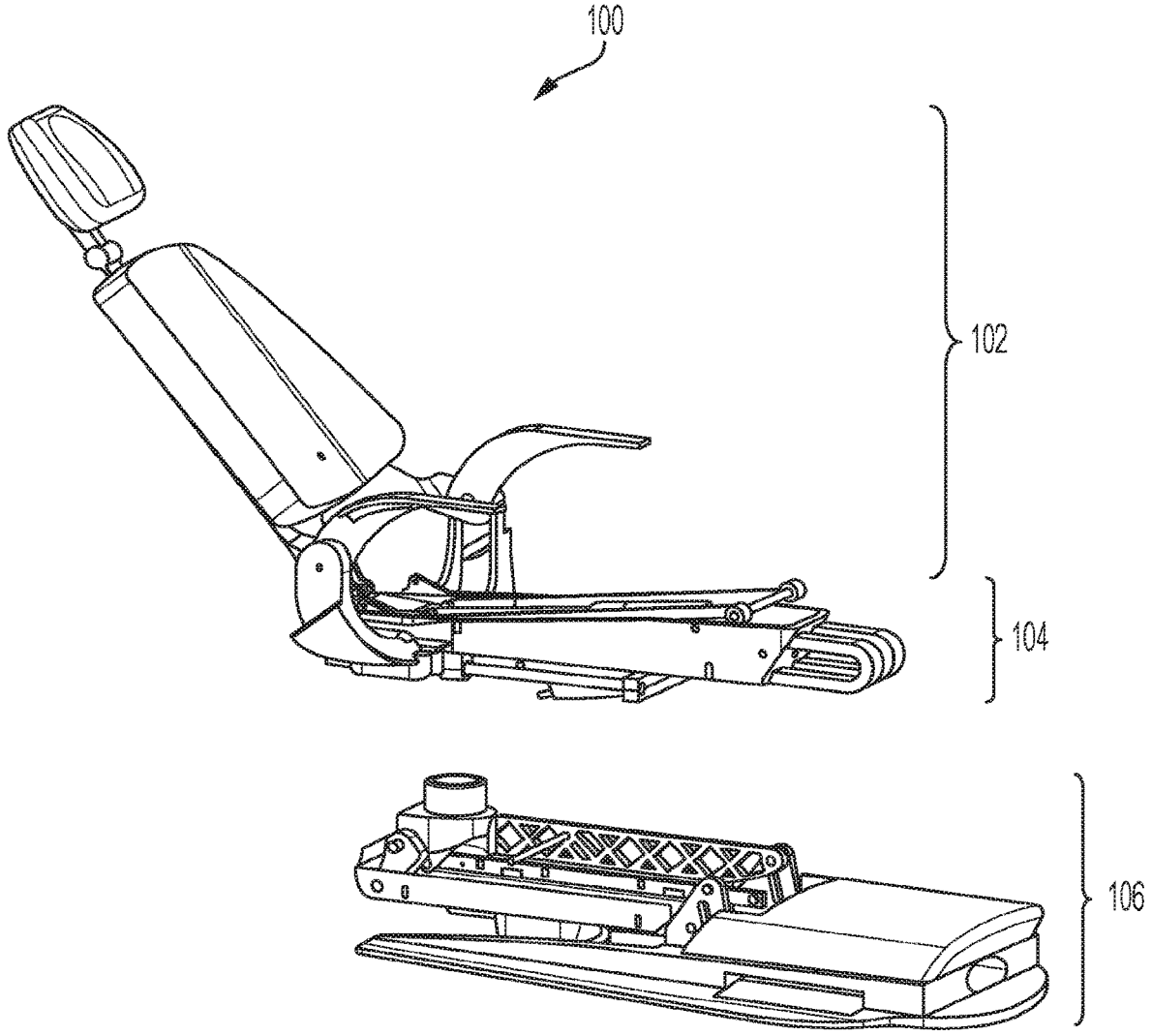
FIG. 7 illustrates an exemplary alignment of chair, lift and base modules.

FIG. 7 illustrates alignment of the chair module 102 over the lift module 104 and the base module 106.

Figure 8:
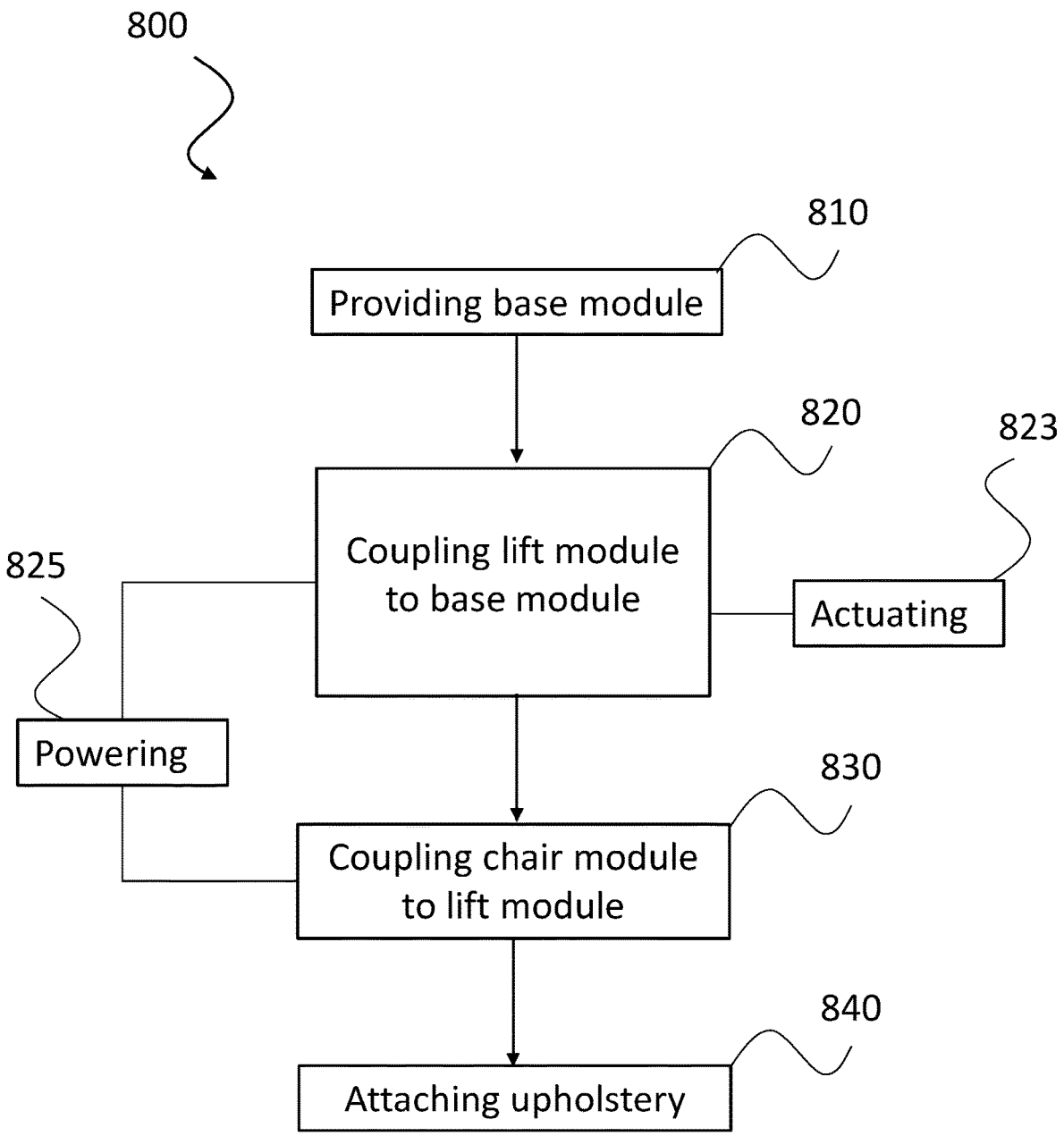
FIG. 8 is a flow diagram illustrating different methods of assembling a modular dental chair.

FIG. 8 is a flow diagram 800 illustrating different methods of assembling a modular dental chair 100 according to the present disclosure. In one embodiment, a method of assembling a modular dental chair 100 includes a providing step 810 of providing a base module 106 having a plurality of base fasteners 404 (e.g., see FIGS. 4 and 10A). The base module 106 may be removed from a shipping container and placed on a floor surface of the desired location.

Next, a coupling step 820 of coupling a lift module 104 to the base module 106, where the lift module 104 includes a plurality of keyed apertures 308 (e.g., see FIGS. 3, 5 and 10B-10E) configured to receive the plurality of base fasteners 404 such that when the lift module 104 is coupled to the base module 106, the plurality of keyed apertures 308 are aligned and secured with the plurality of base fasteners 404 (e.g., see FIGS. 5, 6 and 10B) to prevent a vertical axial movement of the lift module 104.

In another embodiment, the providing and coupling steps 810, 820 may be combined whereby the lift module 104 and the base module 106 are pre-configured and shipped as a single unit. In yet another embodiment, the lift module 104 may be removed from a separate shipping container and mounted over the base module 106 sitting on the floor via a coupling step 820. For example, the lift module 104 may be lowered onto the base module 106 and secured to the stud pins on the base module 106. Alternatively, the lift module 104 may be secured with socket cap screws and tightened securely with a wrench. In one embodiment, the method includes another coupling step 830, which involves coupling a chair module 102 to the lift module 104, the chair module 102 having a fastening mechanism 210 (see FIG. 2) configured to releasably attach to the lift module 104. The above embodiments will be shown and discussed in more details below.

In one embodiment, the base module 106 includes a base plate 402, where electronic components 406 and the plurality of base fasteners 404 are disposed on the base plate 402 similar to that described above. In one embodiment, the method includes a powering step 825, where the powering step includes providing electrical power via electronic components 406 to at least one of the lift module 104 and the chair module 102. In another embodiment, the powering step 825 may also provide electrical power to additional features, where wirings for the electronic components 406 are electrically coupled to portions of at least one of the lift module 104 and the chair module 102. This and other embodiments involving providing power to the lift module 104, the chair module 102, or both, will be discussed in more details below.

In one embodiment, the lift module 104 includes a lift 303, a post 302 positioned on a distal end of the lift 303, and a plate 304 having towers 306 configured to rotatably secure a proximal end of the lift 303 to the plate 304 (see FIG. 3).

In one embodiment, the method includes an actuating step 823 for actuating the lift 303 such that the lift module 104 can be raised or lowered so as to facilitate comfort and ease of coupling the chair module 102 to the lift module 104. In other words, the lift module 104, when coupled and secured to the base module 106, can be elevated to a more suitable level such that when the chair module 102 is attached to the lift module 104, the chair module 102 will be at a suitable height for a user to continue the assembly process thereof. This, too, will be shown and discussed in more details below.

In one embodiment, coupling the chair module 102 to the lift module 104 includes removably coupling fastening mechanism 210 of the chair module 102 to the post 302 of lift module 104, where the post 302 is substantially cylindrical in shape. In another embodiment, the post 302 of the lift module 104 may have threads for mating with a corresponding cavity of the chair module 102.

Figure 11A:
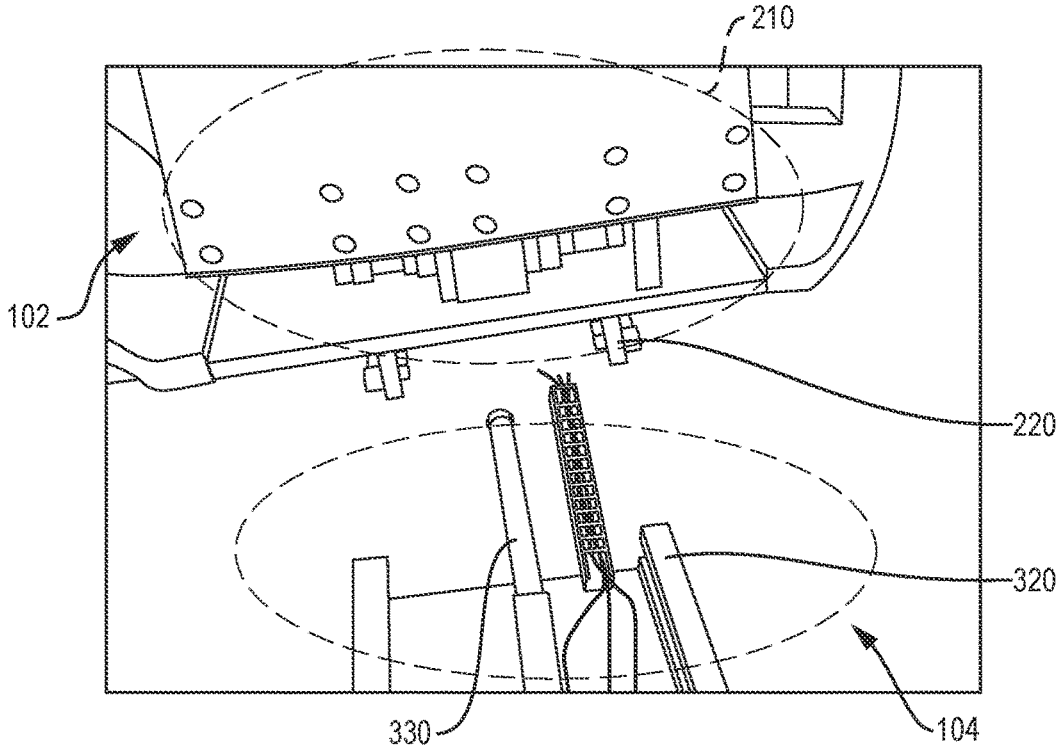
FIGS. 11A-11D are perspective views of the various steps of coupling a chair module to a lift module.
Figure 11B:
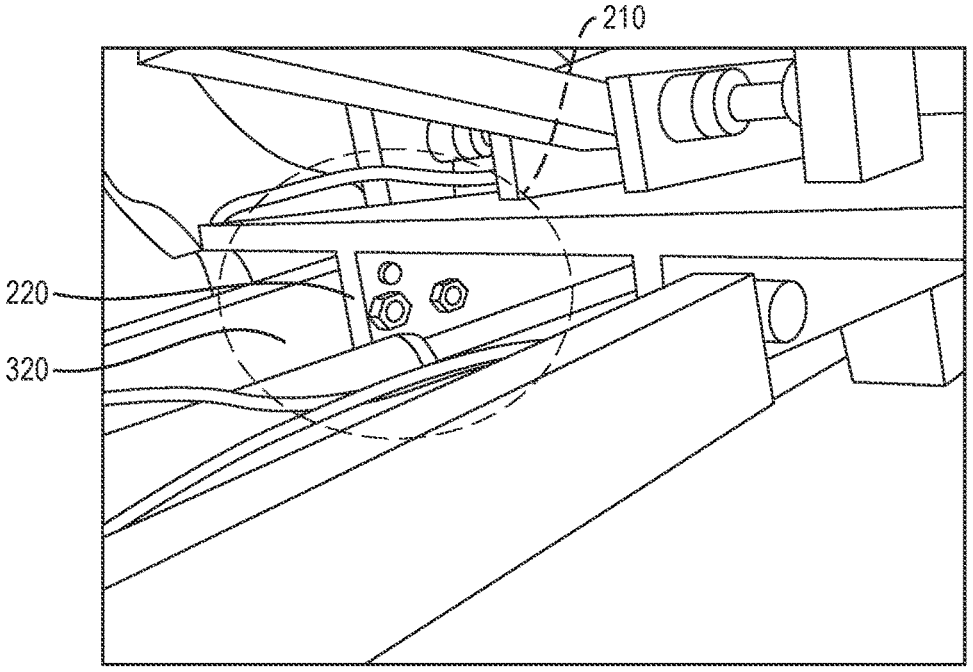

In some embodiments, the chair module 102 may have traverse rollers 220 and the lift module 104 may have traverse rails 320 configured to receive the traverse rollers 220 such that the chair module 102 can be slidably received by the lift module 104 (best illustrated in FIG. 11A-11B). In another embodiment, the chair module 102 may have an engagement aperture 230 and the lift module 104 may have an engagement bar 330 configured to be aligned with the engagement aperture 230 such that the chair module 102 is securely attached to the lift module 104 via a set of bolt 130 and pin 430 through the engagement aperture 230 and the engagement bar 330 (best illustrated in FIGS. 11C-11D). In one embodiment, the engagement bar 330 may be a linear actuator with internal positioning sensor thereby eliminating the need for complex hydraulic pumps, pistons and other feedback systems.

In one embodiment, the chair module 102 includes a back rest assembly 204, a head rest assembly 202 slidably attachable to an upper end of the back rest assembly 204, an arm rest assembly 206, a seat assembly 207 slidably attachable to a lower end of the back rest assembly 204, and a leg rest assembly 208 slidably attachable to the seat assembly 207 (see FIG. 2). In this embodiment, the method further includes an attaching step 840 including attaching various parts of an upholstery package 108 (best illustrated in FIGS. 9 and 14A-14B) to at least one of the back rest assembly 204, the head rest assembly 202, the arm rest assembly 206, the seat assembly 207 and the leg rest assembly 208. In some embodiment, the various parts of an upholstery package 108 may be held in place with clips, pins, zippers or other suitable fasteners.

In some embodiments, each of the base module 106, the lift module 104 and the chair module 102 is made of metal and does not exceed a specified weight of about 150 pounds, or about 100 pounds.

Figure 9:
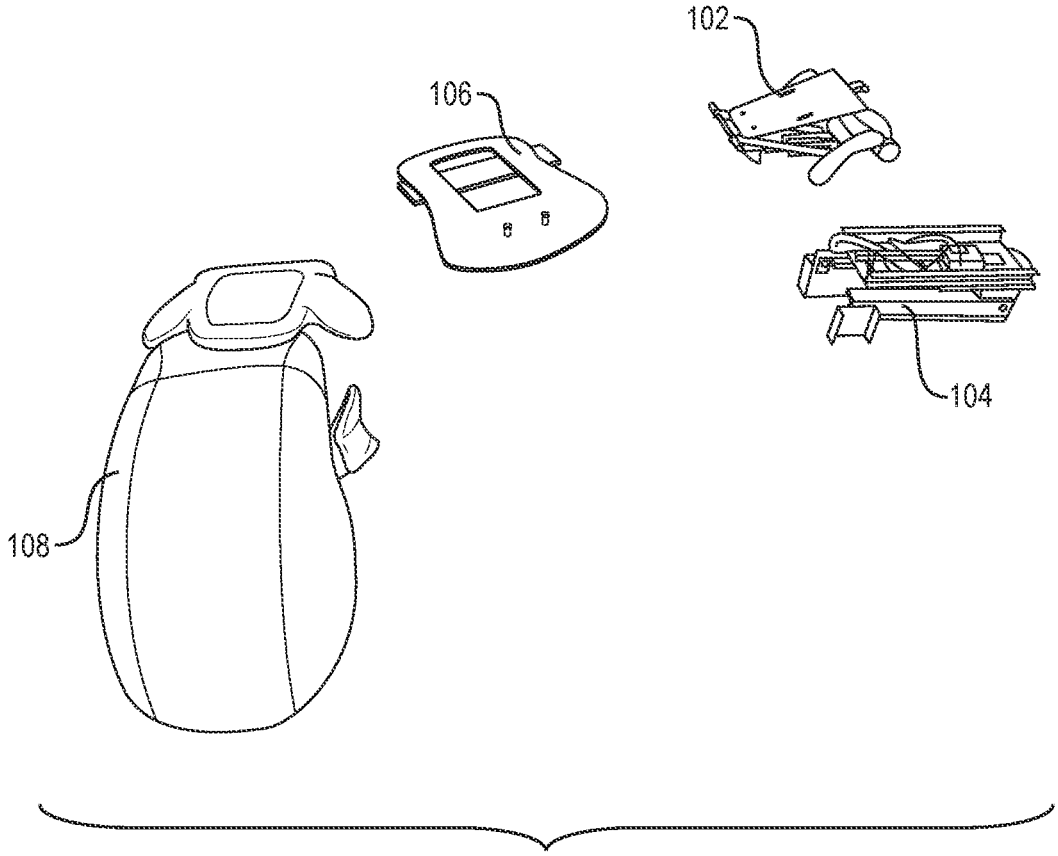
FIG. 9 is a perspective view of the various modules including an upholstery package.

FIG. 9 is a perspective view of the various modules 102, 104, 106 including an upholstery package 108. As shown, the various modules 102, 104, 106 include a chair module 102, a lift module 104 and a base module 106, as described herein. The modules 102, 104, 106 may be separately shipped in packaging that complies with known shipping standards and requirements. In addition, an upholstery package 108 may be separately shipped, or shipped together with the various module 102, 104, 106. The upholstery package 108 may also be provided in an appropriate box in compliance with known shipping standards and requirements.

Figure 10A:
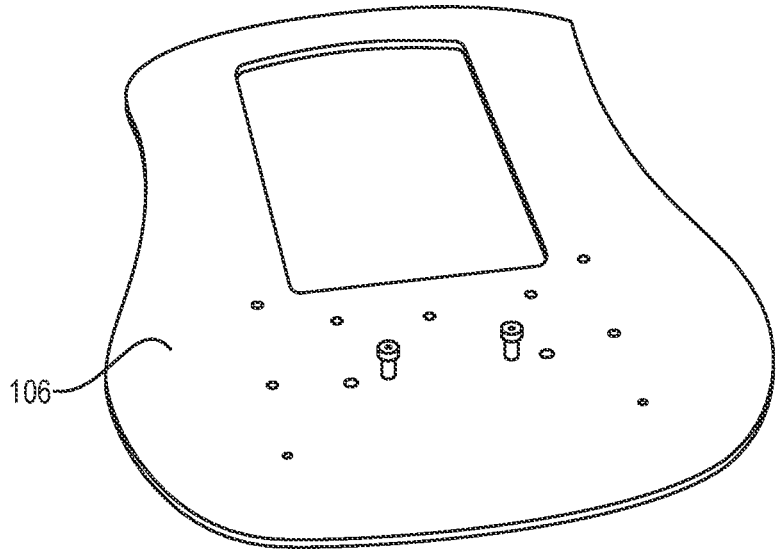
FIGS. 10A-10E are perspective views of the various steps of providing a base module and coupling a lift module to the base module.

FIGS. 10A-10E are perspective views of steps 810 and 820 of providing a base module 106 and coupling a lift module 104 to a base module 106. FIG. 10A shows a perspective view of a providing step 810 by providing a base module 106 in a package as described above. In operation, the base module 106 may be removed from the boxed package as shown in FIG. 9 and placed on a suitable surface. In some embodiments, while the base module 106 may include bolts, they may be substituted with hand screws or other suitable fasteners. Optionally, guide plates (not shown) may be used in facilitating the subsequent coupling step 820 by enhancing the accuracy or placement/positioning of a lift module 104 to the base module 106

Figure 10B:
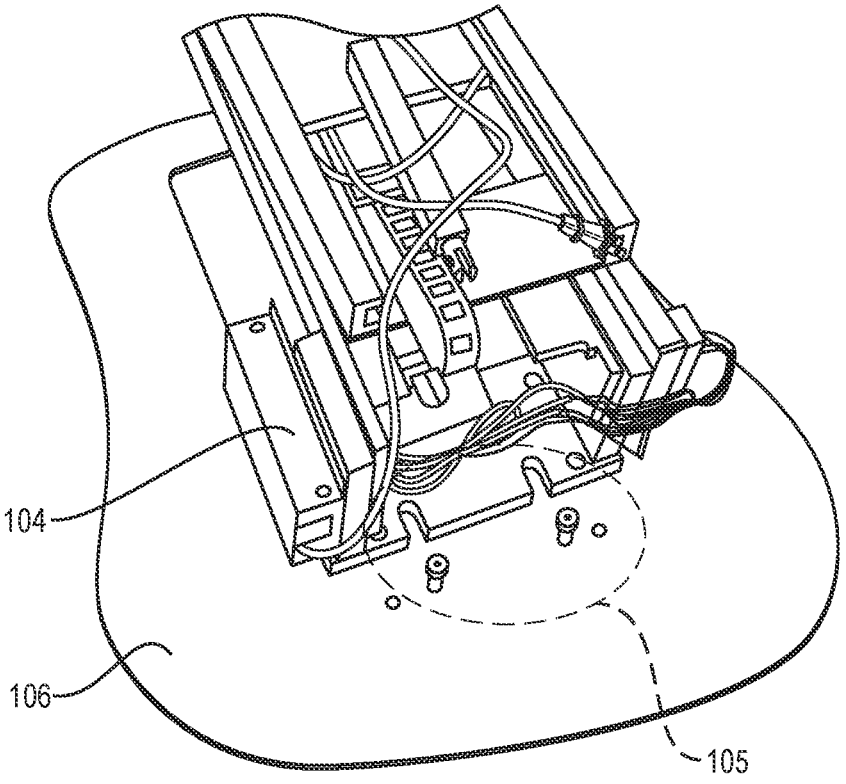

FIG. 10B shows a perspective view of a coupling step 820 as a lift module 104 is coupled to the base module 106. Each of the base module 106 and the lift module 104 may include components (e.g., base plate 402, base fasteners 404, keyed apertures 308) and be joined as that described above and therefore will not be elaborated further herein. In operation, similar to above, the lift module 104 may be joined with or mounted over the base module 106 such that the plurality of keyed apertures 308 are aligned and secured with the plurality of base fasteners 404 to prevent a vertical axial movement of the lift module 104 with respect to the base module 106. This is best illustrated in the dashed circle 105 as shown in FIG. 10B.

In one embodiment, the providing step 810 and the coupling step 820 may be combined in a single step by having the lift module 104 pre-configured or pre-coupled to the base module 106. In this instance, the combined modules 104, 106 may be shipped together as a single unit and may collectively not exceed a specified weight of about 150 pounds, or about 100 pounds.

Figure 10C:
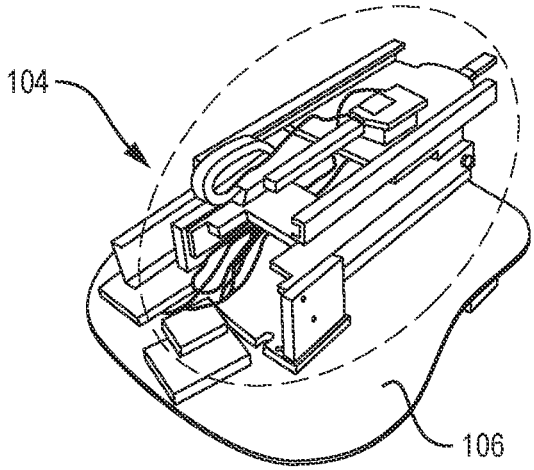

FIG. 10C shows a perspective view of a powering step 825 as the modules 104, 106 are coupled and secured to each other (via bolts or hand screws), and the electronic components 406, contained within the lift module 104, may be powered by connecting the electronic components 406 to a power supply via a power cord. In doing so, the lift module 104 can be raised and lowered, or extended and retracted, among other operations. Alternatively, the lift module 104 may be controlled with a remote control (not shown).

In one embodiment, the lift module 104 may include a lift 303 for raising and lowering the lift module 104. In another embodiment, the lift module 104 may include an engagement bar 330 for engaging with a chair module 102 (this will be shown and discussed in more detail).

Figure 10D:
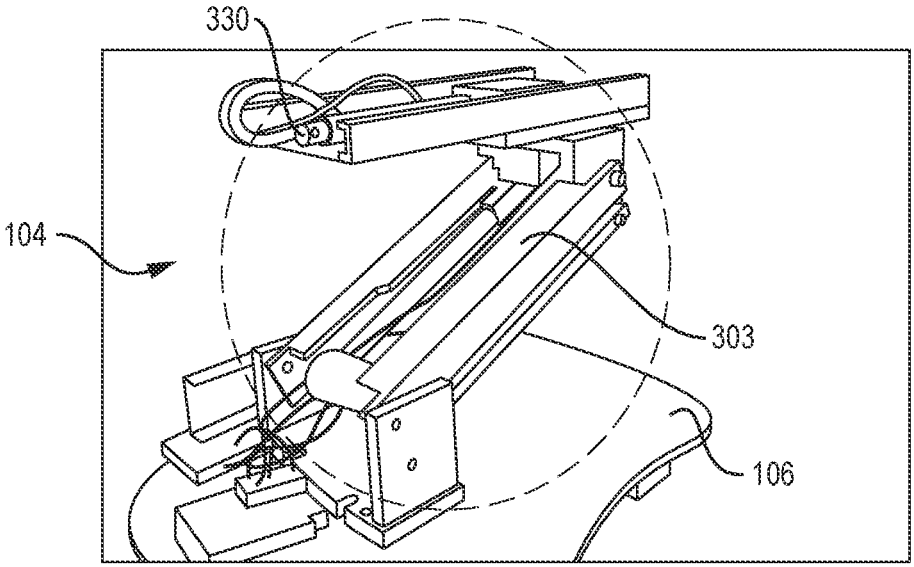
Figure 10E:
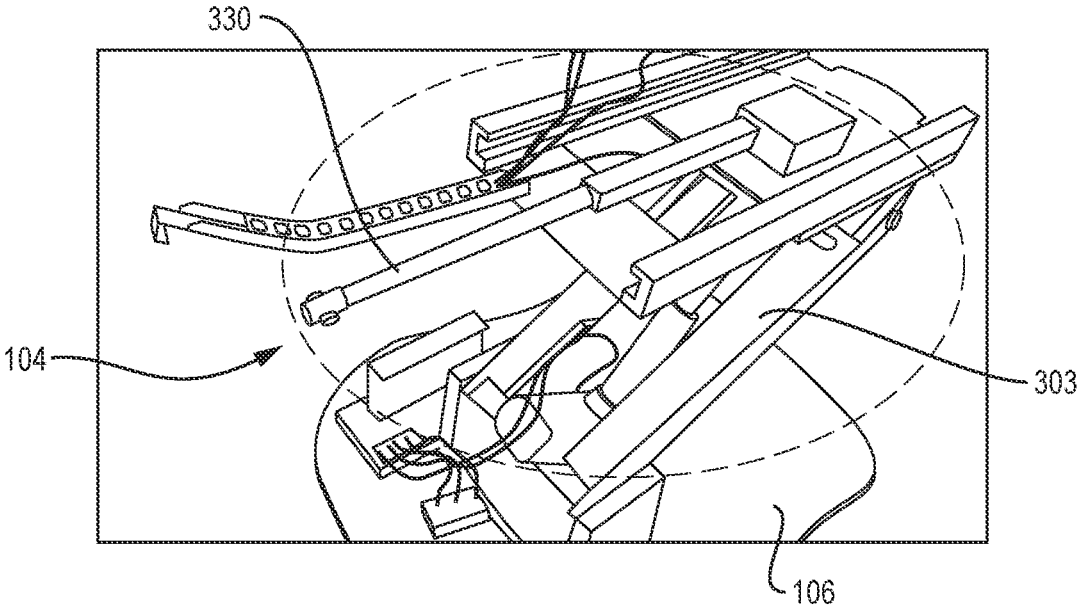

FIGS. 10D-10E show perspective views of an actuating step 823 where the lift 303 of the lift module 104 can be raised and lowered to facilitate comfort and ease of releasably attaching a chair module 102 to the lift module 104. Raising or lowering of the lift module 104 can be accomplished with electronic controls (optionally via a remote control) from the electronic components 406 in conjunction with the powering step 825. Similarly, the engagement bar 330 may be extended or retracted for engaging with the chair module 102. This is best illustrated by comparing FIGS. 10D and 10E, with the former figure showing the engagement bar 330 in a retracted state and the latter figure showing the engagement bar 330 in an extended state. This will become more apparent in subsequent figures and discussion. Regardless, in both FIGS. 10D and 10E, the lift 303 has been substantially elevated from the bottom of the base module 106. In other words, the arm of the lift 303 is angled and not substantially horizontal or planar with respect to the surface of the floor.

In some instances, to facilitate ease of assembling the chair module 102 and upholstery package 108, the lift module 104 may be raised and/or extended to a suitable height/position. This can be done by plugging in a power cord and pushing and holding actuation controls to electrically drive the lift 303 of the lift module 104 vertically up or down, or to drive the engagement bar 330 of the lift module 104 horizontally forward or backward.

In some embodiments, the lift module 104 may be raised or lowered with purely pneumatic or mechanical controls. In other embodiments, the lift module 104 can be raised or lowered with electrical, mechanical, hydraulic, electro-mechanical controllers, or other suitable mechanisms and/or controllers.

In some embodiments, the powering step 825 further includes providing electrical power to powering additional features of at least one of the lift module 104 and the chair module 102 with the electronic components 406, where wirings for the electronic components 406 are electrically coupled to portions of at least one of the lift module 104 and the chair module 102.

In one embodiment, releasably attaching the chair module 102 to the lift module 104 further includes mating a cavity of the chair module to the post 302 of the lift module 104, the post 302 being substantially cylindrical in shape and having corresponding threads for mating with the cavity, similar to that described above and will not be elaborated further herein.

FIGS. 11A-11D are perspective views of step 830 of coupling a chair module 102 to a lift module 104, which has already been coupled and secured to the base module 106 as discussed earlier. Next, the chair module 102 is to be joined with both modules 104, 106 in forming an embodiment of a modular dental chair 100. For the sake of brevity, when referring to the lift module 104 in this section it will be understood to include both the lift module 104 and the base module 106.

FIGS. 11A-11B show perspective views of the chair module 102 being raised and joined to the lift module 104. In this instance, the engagement is taking place by lifting the chair module 102 and engaging with the lift module 104 with the backside of the chair module 102 facing the lift module 104. Alternatively, the chair module 102 may also engage the lift module 104 from the frontside (not shown).

In one embodiment, the coupling step 830 includes attaching a chair module 102 to the lift module 104 via a fastening assembly 210, where the fastening assembly 210 includes the chair module 102 having a set of traverse rollers 220 (best illustrated in FIGS. 11A-11B), and the lift module 104 includes corresponding traverse rails 320 (best illustrated in FIG. 11B) configured to receive the traverse rollers 220 of the chair module 102. In this embodiment, the chair module 102 may be received onto the lift module 104 from the rear of the chair module 102 by sliding the traverse rollers 220 into the traverse rails 320 as best illustrated in FIGS. 11A-11B.

Figure 11C:
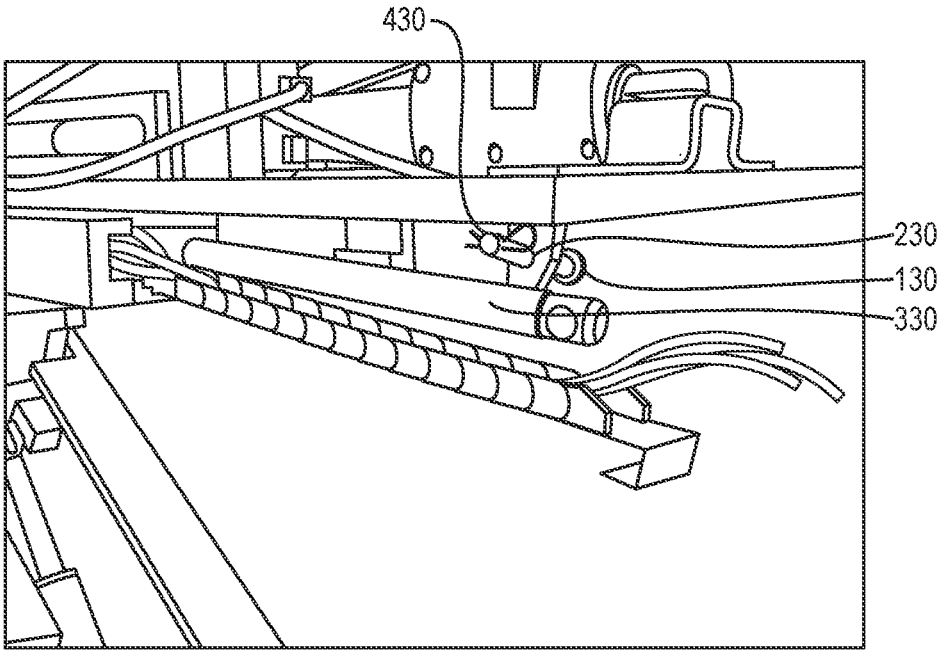
Figure 11D:
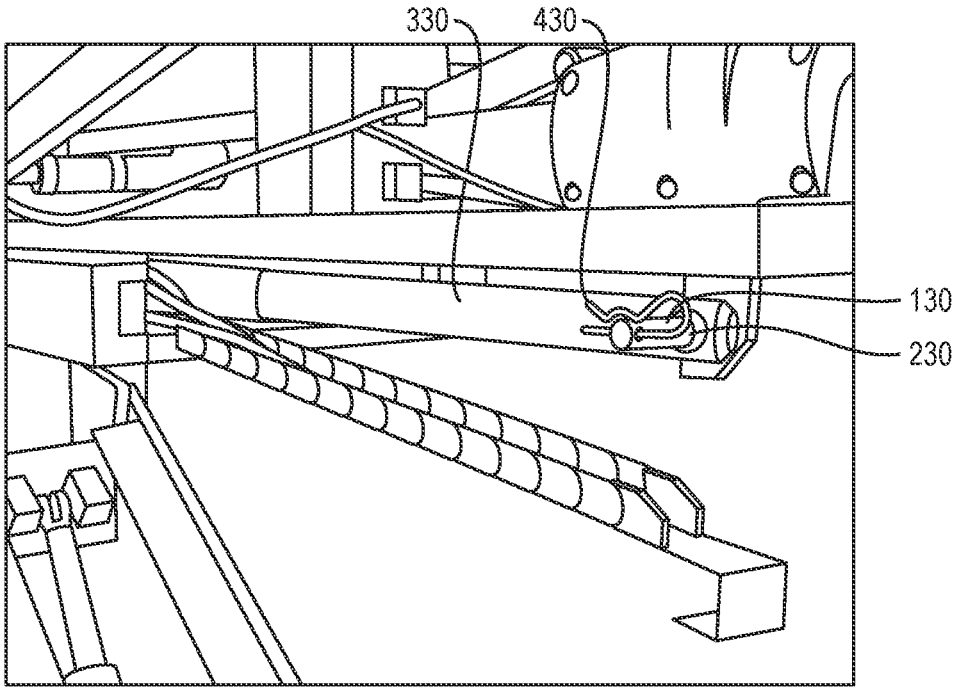

FIGS. 11C-11D show perspective views of releasably attaching the chair module 102 to the lift module 104. In this embodiment, once the traverse rollers 220 are aligned and received by the corresponding traverse rails 320, the bottom side of the chair module 102 includes an engagement aperture 230 that can be secured with bolt 130 and pin 430, while the top side of the lift module 104 includes an engagement bar 330 as shown and discussed earlier.

In operation, to releasably secure the chair module 102 to the lift module 104, the bolt 130 and pin 430 are initially removed from the engagement aperture 230. Next, the engagement bar 330, along with a corresponding aperture, can be aligned with the engagement aperture 230. The engagement bar 330 can be manipulated (e.g., extended or retracted, raised or lowered) as necessary until the aperture of the engagement bar 330 and the engagement aperture 230 are aligned. Once aligned, the bolt 130 may be reinserted through both the aperture of the engagement bar 330 as well as the engagement aperture 230 to ensure that the chair module 102 and the lift module 104 are secured with each other. The pin 430 may subsequently be inserted to ensure the bolt 130 is secured, as best illustrated in FIG. 11D, showing the chair module 102 being firmly secured to the lift module 104 with both the bolt 130 and pin 430 in place and the engagement bar 330 secured and in alignment with the engagement aperture 230.

Like above, the engagement bar 330 may be electrically operated. In another embodiment, the engagement bar 330 may be manually or mechanically operated. In some embodiments, electronic, mechanical electro-mechanical controls or combinations thereof, may be used to raise or lower the lift module 104, and similar controls may be used to extend or retract the engagement bar 330, so as to bring the engagement bar 330 in alignment with the engagement aperture 230. Additionally, as shown in FIGS. 11C-11D, while the engagement aperture 230 and the engagement bar 330 can be aligned and secured with the shown bolt 130 and locking pin 430 combination (e.g., clevis fastener, clevis pin with hairpin), it is understood that alternative fasteners may be utilized (e.g., cotter pin, split pin).

Figure 12:
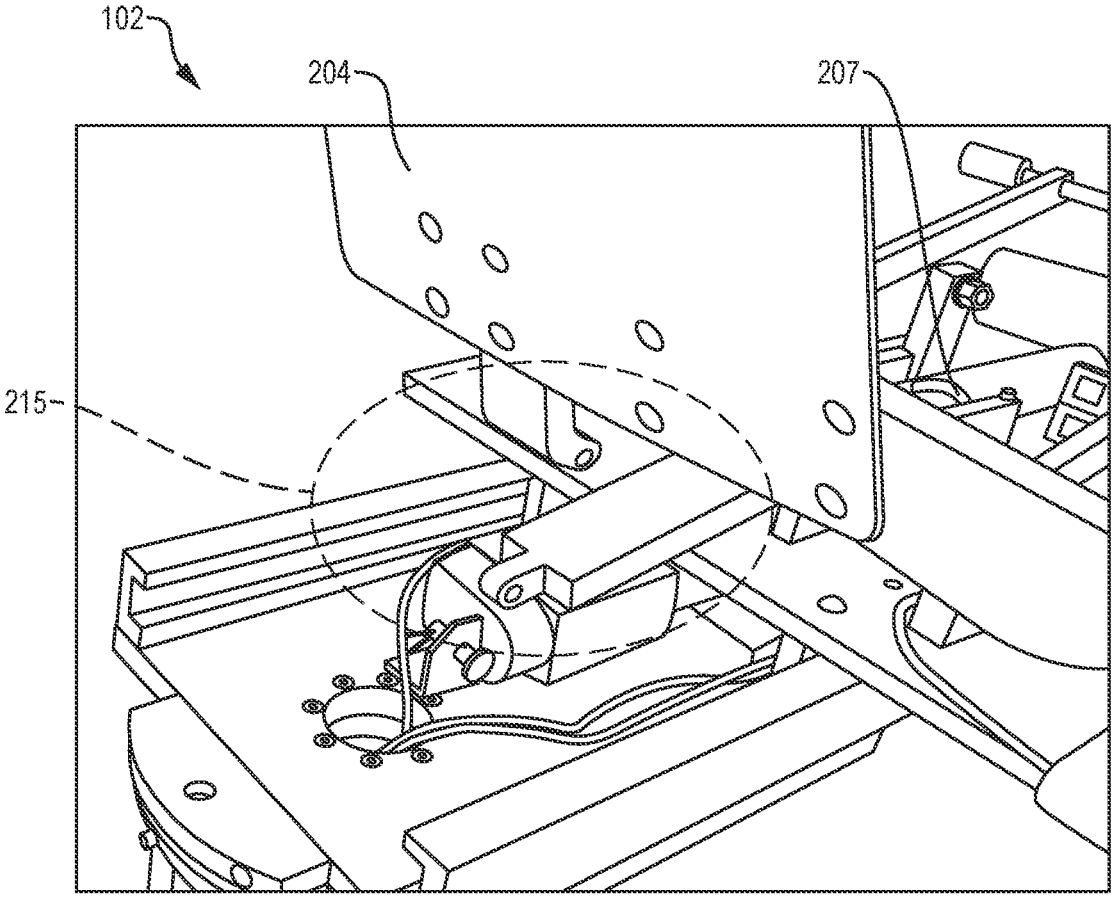
FIG. 12 is a perspective view of securing a seat back portion to a seat base portion of a chair module.

FIG. 12 is a perspective view of securing a seat back portion 204 to a seat base portion 207 of a chair module 102. As shown, to make it easier to ship the chair module 102, the seat back portion 204 may be in a folded configuration (e.g., stored or shipping configuration) with respect to the seat base portion 207. During the assembly process, the seat back portion 204 of the chair module 102 needs to be converted to an upright configuration (e.g., extended or in-use configuration) with respect to the seat base portion 207. In one embodiment, this can be accomplished via a similar bolt and locking pin fastener combination as described above and shown in dotted circle 215. In the upright or in-use configuration, the seat back portion 204 should be substantially perpendicular with respect to the seat base portion 207 so as to simulate a dental chair for which a user can be seated thereon.

Figure 13A:
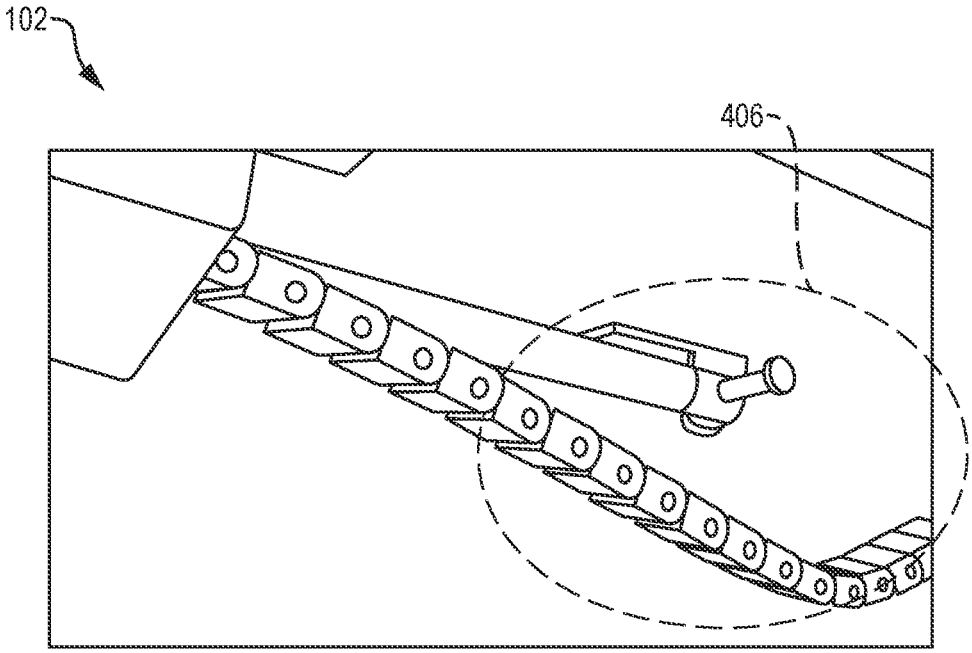
FIGS. 13A-13C are perspective views of the various steps of connecting electronic components of a modular dental chair.
Figure 13B:
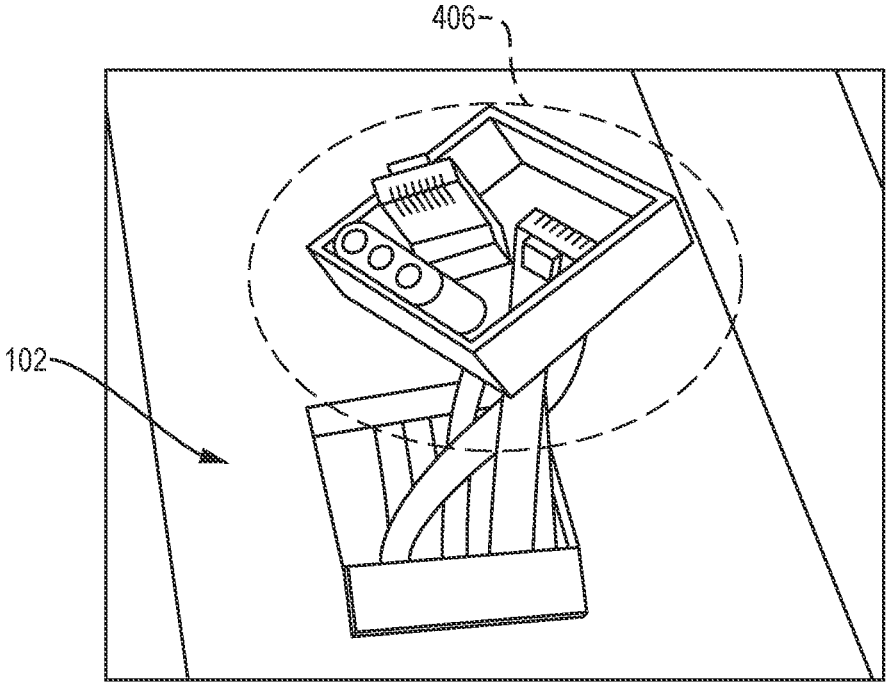
Figure 13C:
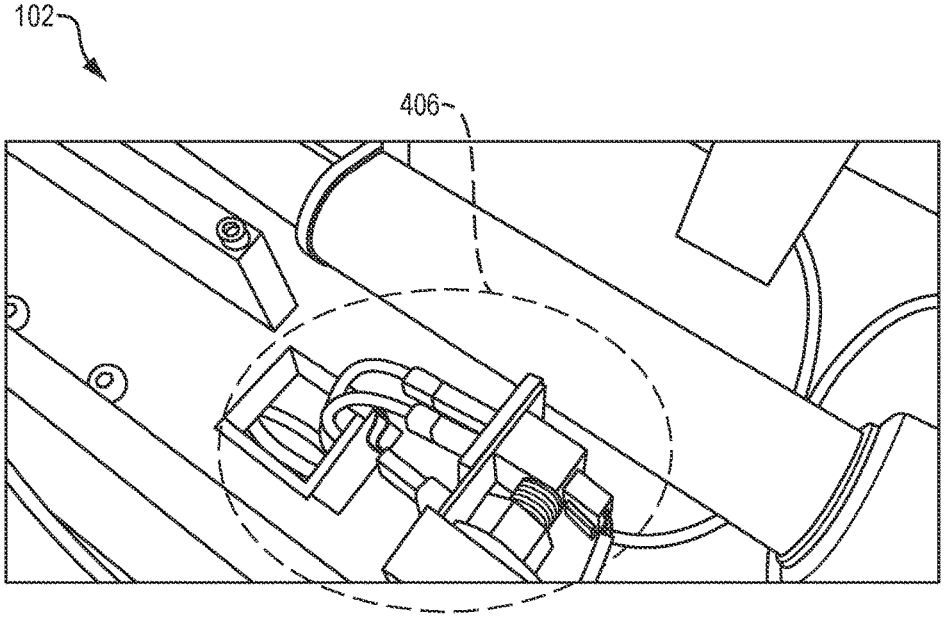

FIGS. 13A-13C are perspective views of the various steps of connecting the electronic components 406 of a modular dental chair 100. As shown in FIG. 13A, the electronic components 406 may include a plurality of electrical wires. These electrical wires may provide various electronic controls to not only the lift module 104 but also the chair module 102 (e.g., Wi-Fi connection, tilting, raising or lowering the chair, integrated heat and massage controls, remote monitoring or sensing, among others). As such, it may be necessary to couple the electronic components 406 to not only the lift module 104 but also to the chair module 102.

FIG. 13B is a perspective view of an aperture formed about a portion of the chair module 102. As shown, electrical wires for the electronic components 406 may be routed through the aperture about a bottom portion of the chair module 102. In one embodiment, a plurality of wires (e.g., low voltage and control cables) may be connected to the dental chair by feeding the wires through the aperture and securing the same with a chain bracket. The chain bracket may also be secured with a grommet.

FIG. 13C is a perspective view showing receptacles (best illustrated in dotted circle) on the chair module 102 for receiving the plurality of wires of the electronic components 406. In some embodiments, the wires and the corresponding receptacles may be customized (e.g., by size, by color) to ensure that they are properly received as can be appreciated by one skilled in the art. Once connected, the chair module 102 is ready for an upholstery application, e.g., attaching of upholstery to the chair module 102.

Figure 14A:
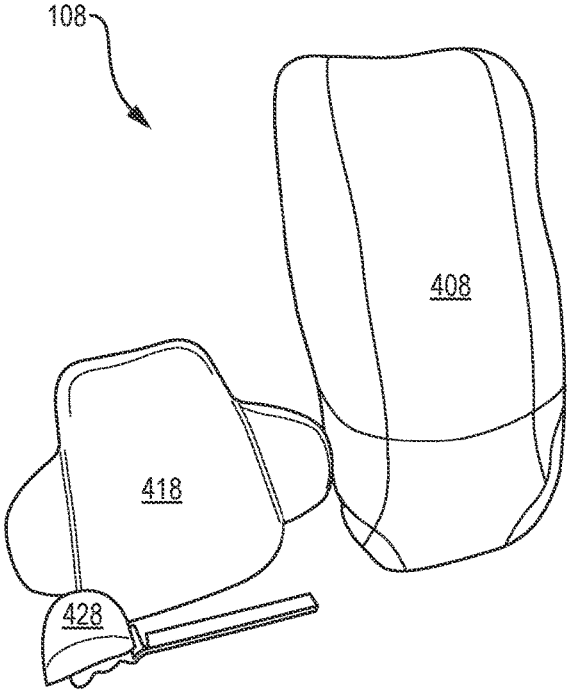
FIGS. 14A-14B are perspective views of various parts of an upholstery package.
Figure 14B:
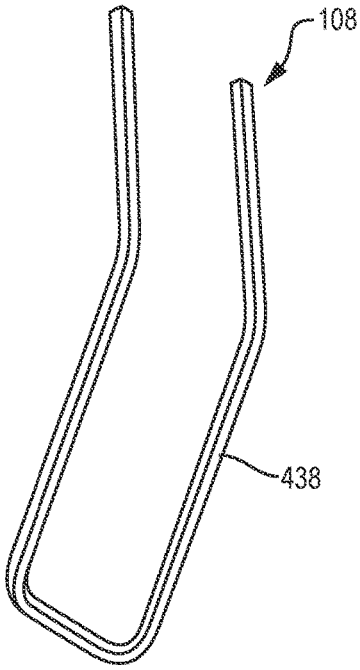

FIGS. 14A-14B are perspective views of the various parts of an upholstery package 108. As shown, the upholstery package 108 includes an upholstered seat 408, an upholstered backrest 418, an upholstered headrest 428, and a leg support 438 for the upholstered seat 408.

FIGS. 15A-15D are perspective views of the attaching step 840 of attaching an upholstery package 108 to a chair module 102. For the sake of brevity and for purposes of this section, the chair module 102 will be understood to also include both the lift module 104 and the base module 106.

Figure 15A:
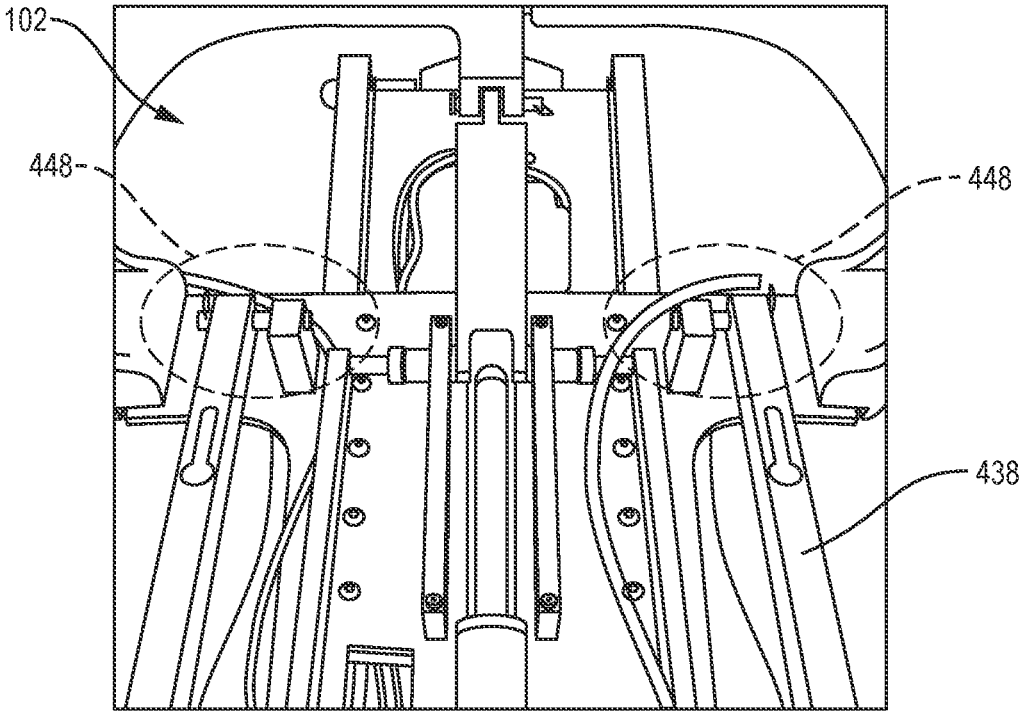
FIGS. 15A-15D are perspective views of the various steps of attaching an upholstery package to a chair module.

FIG. 15A shows a perspective view of attaching the leg support 438 to the chair module 102. The leg support 438, made of a metallic material, among other suitable material, is necessary so as to provide the required weight support when the upholstered seat 408 is mounted on the chair module 102 and a user is sitting on the upholstered seat 408. In this instance, the leg support 438 may be secured to portions of the chair module 102 with the bolt and pin combination as discussed above and shown in dotted circles 448, and will not be elaborated further herein. The leg support 438 may also be secured to the chair module 102 via other fastening mechanisms (e.g., screws), as can be appreciated by one skilled in the art.

Figure 15B:
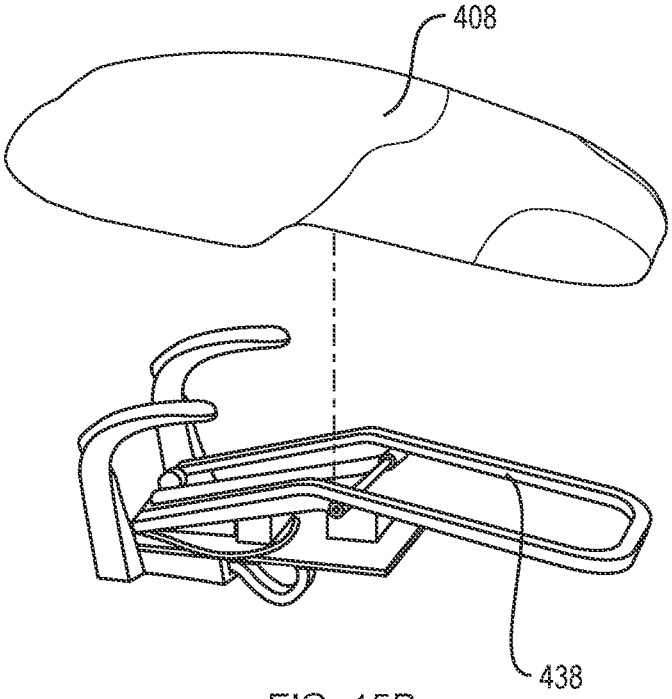
Figure 15C:
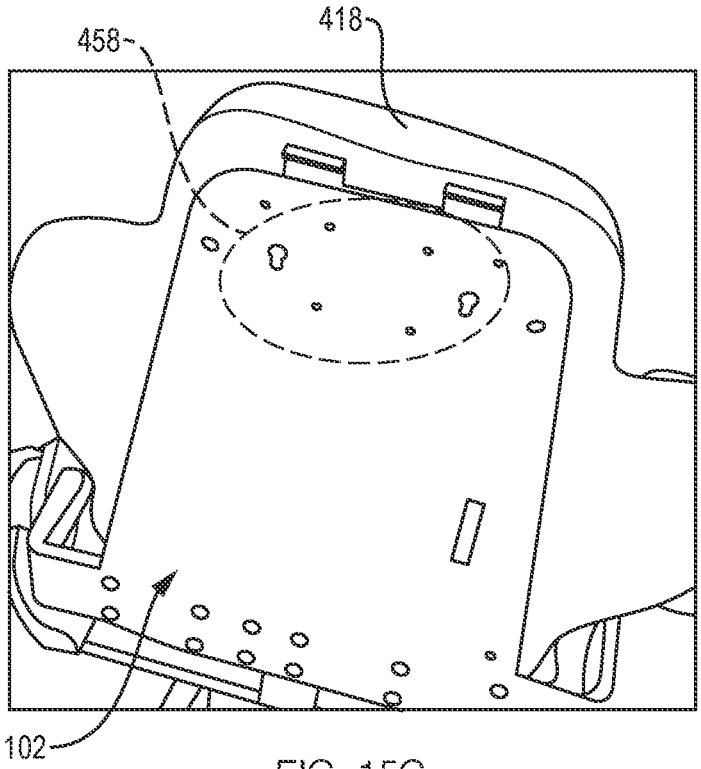
Figure 15D:
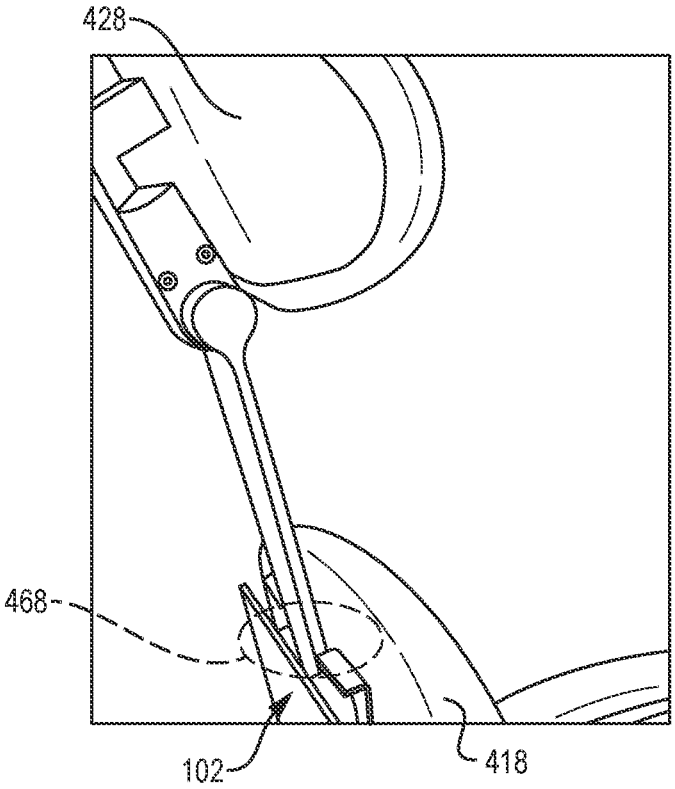

Next, FIG. 15B shows a perspective view of the upholstered seat 408 being mounted on top of the leg support 438. In this instance, the upholstered seat 408 may be clipped onto the leg support 438. FIG. 15C shows the upholstered backrest 418 being secured to the chair module 102 via a plurality of screws as best illustrated in dotted circle 458. Alternatively, the upholstered backrest 418 may be secured to the chair module 102 via other suitable fasteners. Next, FIG. 15D shows the upholstered headrest 428 being secured between the upholstered backrest 418 and the chair module 102 via a recess as best illustrated in dotted circle 468. In this instance, the upholstered headrest 428 may be frictionally received within the recess and may be manipulated (e.g., raised up or down) accordingly.

Figure 16:
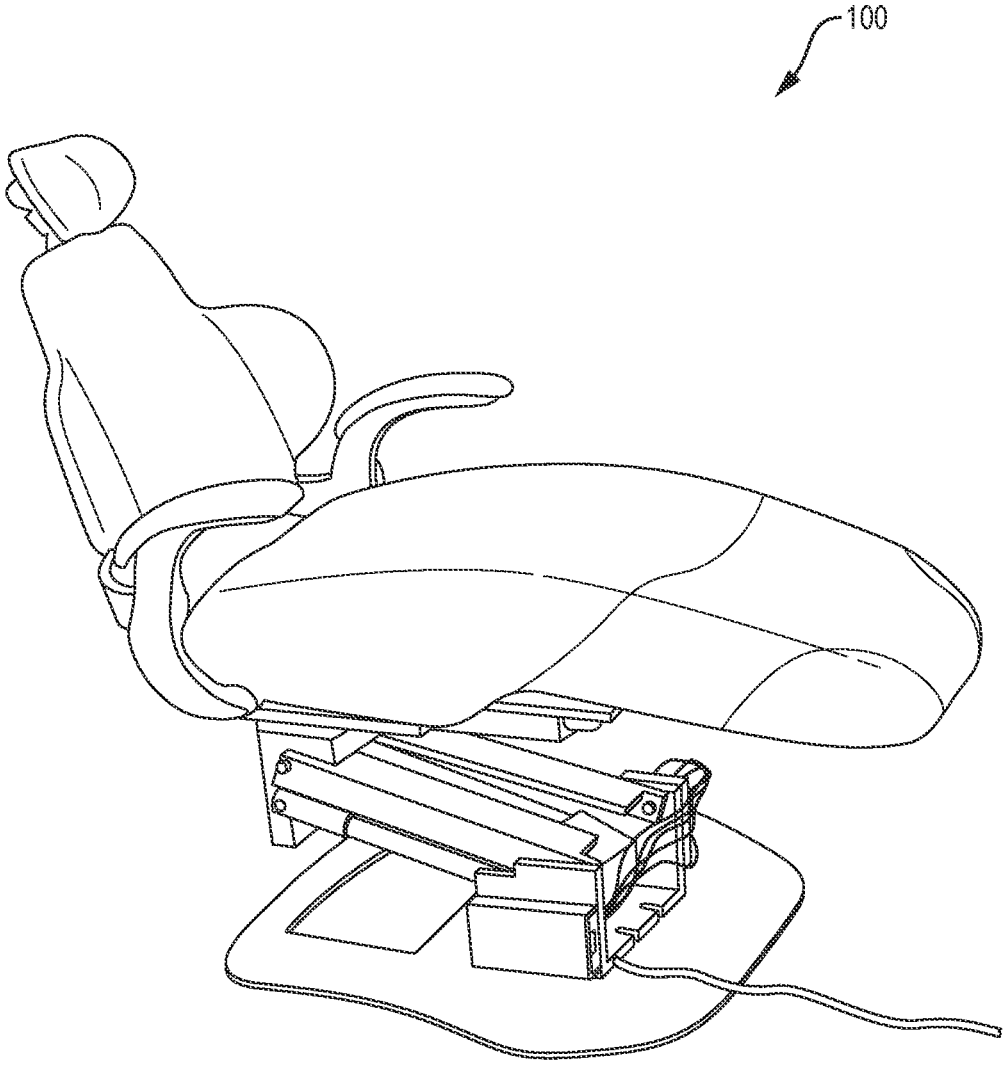
FIG. 16 is a perspective view of an assembled dental chair using the plurality of modules and an upholstery package according to an embodiment of the present disclosure.

FIG. 16 is a perspective view of an assembled dental chair 100 using the plurality of modules 102, 104, 106 and an upholstery package 108 according to an embodiment of the present disclosure. In short, the presently disclosed embodiments are lighter in weight overall due to the modularity of the dental chair. The lightweight modular structure allows the components to be shipped in separate containers via suitable shipping providers. For example, each of the base module, the lift module and the chair module can be packaged and shipped in separate containers. In some instances, the upholstery may also be packaged and shipped separately. In the alternative, the upholstery may be pre-mounted on each of the modules.

In addition, because the modules can be assembled without skilled labor, this can translate to significantly reduced costs. And because the electronic components can be integrated into a central processor unit which can be configured with multiple options, each module of the chair can be remotely sensed (e.g., over a network or via the Internet of Things) thereby providing real-time monitoring of the dental chair for service needs. And in the event of any perceived or predicted maintenance or failure needs, replacement modules can be immediately shipped to the dental provider so as to minimize the downtime and the need for skilled labor to be onsite for such replacement. This can be especially important in rural areas where access to dental services may be problematic.

Additionally, different upholstery packages may be shipped via mail for repair, replace or upgrade purposes. While the dental chair embodiments described above are mostly for general practice dental providers (e.g., basic configurations), it will be appreciated that additional functions or modules (e.g., compressors, suction units, dual motors) may be implemented such that the dental chair embodiments may be modified for surgical or sedation purposes (e.g., advanced configurations).

While the present invention has been described with reference to certain embodiments thereof, it should be understood by those skilled in the art that various changes may be made and equivalents may be substituted without departing from the true spirit and scope of the invention. In addition, many modifications may be made to adapt to a particular situation, indication, material and composition of matter, process step or steps, without departing from the spirit and scope of the present invention. All such modifications are intended to be within the scope of the present invention.

What is claimed is:

1. A method comprising:

providing a base module having a plurality of base fasteners;

coupling a lift module to the base module, the lift module having a plurality of keyed apertures configured to receive the plurality of base fasteners such that when the lift module is coupled to the base module, the plurality of keyed apertures are aligned and secured with the plurality of base fasteners to prevent a vertical axial movement of the lift module; and coupling a chair module to the lift module, the chair module having a fastening mechanism configured to releasably attach to the lift module;

wherein the lift module further comprises a lift, and a plate having towers configured to rotatably secure a proximal end of the lift to the plate, the method further comprising:

actuating the lift such that the lift module can be raised or lowered so as to facilitate comfort and ease of coupling the chair module to the lift module.

2. The method of claim 1, wherein coupling the chair module to the lift module further comprises removably coupling the fastening mechanism of the chair module to a post of the lift module, wherein the post is substantially cylindrical in shape.

3. The method of claim 2, wherein coupling the chair module to the lift module further comprises the post of the lift module having threads to mate with a corresponding cavity of the chair module.

4. The method of claim 1, wherein coupling the chair module to the lift module further comprises the chair module having traverse rollers and the lift module having traverse rails configured to receive the traverse rollers such that the chair module is slidably received by the lift module.

5. The method of claim 1, wherein coupling the chair module to the lift module further comprises the chair module having an engagement aperture and the lift module having an engagement bar configured to be aligned with the engagement aperture such that the chair module is securely attached to the lift module via a locking pin through the engagement aperture and the engagement bar.

6. A method comprising:

providing a lift module joined with a base module, the base module having a base plate and a plurality of base fasteners disposed on the base plate, the lift module having a plurality of keyed apertures configured to receive the plurality of base fasteners, wherein the lift module is joined with the base module such that the plurality of keyed apertures are aligned and secured with the plurality of base fasteners to prevent a vertical axial movement of the lift module with respect to the base module; and attaching a chair module to the lift module via a fastening assembly, wherein the fastening assembly includes the chair module having traverse rollers and the lift module having traverse rails configured to receive the traverse rollers.

7. The method of claim 6, further comprising powering at least one of the lift module and the chair module with electronic components mounted on the base plate.

8. The method of claim 7, wherein the powering step further comprises powering additional features of at least one of the lift module and the chair module with the electronic components, wherein wirings for the electronic components are electrically coupled to portions of at least one of the lift module and the chair module.

9. The method of claim 6, wherein the lift module further comprises a lift, and a plate having towers configured to rotatably secure a proximal end of the lift to the plate, the method further comprising:

actuating the lift such that the lift module can be raised or lowered so as to facilitate comfort and ease of releasably attaching the chair module to the lift module.

10. The method of claim 9, wherein releasably attaching the chair module to the lift module further comprising mating a cavity of the chair module to a post of the lift module, the post being substantially cylindrical in shape and having corresponding threads for mating with the cavity.

11. The method of claim 6, wherein releasably attaching the chair module to the lift module via the fastening assembly further comprising the chair module having an engagement aperture and the lift module having an engagement bar configured to be aligned with the engagement aperture such that the chair module is securely attached to the lift module via a locking pin through the engagement aperture and the engagement bar.

12. The method of claim 6, wherein the chair module includes a back rest assembly, a head rest assembly slidably attachable to an upper end of the back rest assembly, an arm rest assembly, a seat assembly slidably attachable to a lower end of the back rest assembly, and a leg rest assembly slidably attachable to the seat assembly, the method further comprising:

attaching upholstery to at least one of the back rest assembly, the head rest assembly, the arm rest assembly, the seat assembly and the leg rest assembly.

13. A method comprising:

providing a base module having a plurality of base fasteners;

coupling a lift module to the base module, the lift module having a plurality of keyed apertures configured to receive the plurality of base fasteners such that when the lift module is coupled to the base module, the plurality of keyed apertures are aligned and secured with the plurality of base fasteners to prevent a vertical axial movement of the lift module;

providing a chair module having a back rest assembly, a head rest assembly slidably attachable to an upper end of the back rest assembly, an arm rest assembly, a seat assembly slidably attachable to a lower end of the back rest assembly, and a leg rest assembly slidably attachable to the seat assembly;

attaching the chair module to the lift module via a fastening assembly, wherein the fastening assembly includes the chair module having traverse rollers and the lift module having traverse rails configured to receive the traverse rollers; and attaching upholstery to at least one of the back rest assembly, the head rest assembly, the arm rest assembly, the seat assembly and the leg rest assembly.

14. The method of claim 13, further comprising at least one of:

powering at least one of the lift module and the chair module with electronic components mounted on the base module; and powering additional features of at least one of the lift module and the chair module with the electronic components, wherein wirings for the electronic components are electrically coupled to portions of at least one of the lift module and the chair module.

15. The method of claim 14, wherein the lift module further comprises a lift, and a plate having towers configured to rotatably secure a proximal end of the lift to the plate, the method further comprising:

actuating the lift with the electronic components such that the lift module can be raised or lowered so as to facilitate comfort and ease of releasably attaching the chair module to the lift module.

* * * * *